US007614331B2

(12) United States Patent
Schaefer

(10) Patent No.: US 7,614,331 B2
(45) Date of Patent: Nov. 10, 2009

(54) ORGANIZER FOR DISPENSING ROLLED GOODS

(76) Inventor: Lloyd G Schaefer, 15701 Howe St., Overland Park, KS (US) 66224

( * ) Notice: Subject to any disclaimer, the term of this patent is extended or adjusted under 35 U.S.C. 154(b) by 333 days.

(21) Appl. No.: 11/253,761

(22) Filed: Oct. 19, 2005

(65) Prior Publication Data

US 2006/0096937 A1 May 11, 2006

Related U.S. Application Data

(60) Provisional application No. 60/625,739, filed on Nov. 5, 2004.

(51) Int. Cl.

| | |
|---|---|
| ***B26D 7/00*** | (2006.01) |
| ***B26F 3/02*** | (2006.01) |
| ***B65H 35/10*** | (2006.01) |
| ***B65H 75/00*** | (2006.01) |
| ***B65H 16/06*** | (2006.01) |
| ***B65H 18/02*** | (2006.01) |
| ***B65H 49/38*** | (2006.01) |

(52) U.S. Cl. ..... 83/649; 83/650; 242/591; 242/594; 242/596.8; 225/6

(58) Field of Classification Search ..... 83/650; 206/391, 394, 395, 396, 389, 390, 399, 400–417; 242/560, 560.1, 560.2, 591, 594, 596.3, 596.8
See application file for complete search history.

(56) References Cited

U.S. PATENT DOCUMENTS

| | | | | |
|---|---|---|---|---|
| 4,197,774 | A | 4/1980 | Singh et al. | |
| 4,369,929 | A | 1/1983 | Cayer | |
| 4,595,154 | A | 6/1986 | Swope | |
| 4,787,284 | A | 11/1988 | Chen | |
| 4,903,909 | A * | 2/1990 | Suzuki | 242/421 |
| 4,934,575 | A | 6/1990 | Mustafa | |
| D314,087 | S | 1/1991 | Macklin | |
| 5,011,059 | A * | 4/1991 | Jennings et al. | 225/35 |
| 5,025,692 | A | 6/1991 | Reynolds | |
| D319,840 | S | 9/1991 | Hatsumi et al. | |
| D322,974 | S | 1/1992 | Mori | |
| 5,146,828 | A | 9/1992 | Huang et al. | |
| 5,243,890 | A | 9/1993 | Ober | |
| 5,301,854 | A | 4/1994 | Scobey | |
| 5,398,576 | A | 3/1995 | Chiu | |
| 5,415,357 | A | 5/1995 | Smith | |
| D376,940 | S | 12/1996 | Logan | |
| 5,593,035 | A | 1/1997 | Taylor et al. | |
| D379,193 | S | 5/1997 | Cornell | |
| 5,758,559 | A | 6/1998 | Capitao et al. | |
| 5,768,968 | A | 6/1998 | Park et al. | |
| 5,904,329 | A | 5/1999 | Kanome et al. | |
| 5,941,476 | A * | 8/1999 | Copass | 242/588.6 |
| D415,519 | S | 10/1999 | Mori | |
| 6,006,502 | A | 12/1999 | Smith | |
| D425,548 | S | 5/2000 | Rellinger | |
| 6,439,501 | B1 | 8/2002 | Harmathy | |
| 6,592,013 | B1 | 7/2003 | Fujiwara | |
| 6,592,067 | B2 | 7/2003 | Denen et al. | |
| 6,761,298 | B1 | 7/2004 | Cantrell | |
| 2004/0040429 | A1 | 3/2004 | Nichols et al. | |

* cited by examiner

*Primary Examiner*—Ghassem Alie
*Assistant Examiner*—Bharat C Patel
(74) *Attorney, Agent, or Firm*—David E Herron, II

(57) ABSTRACT

The invention is an organizer for dispensing rolled goods. The organizer has first and second carousels positioned adjacent opposing ends of an axle. Additionally, each of the first and second carousels comprises a plurality of connector hubs, each adapted to receive a hollow end of a respective roll of rolled goods. A preferred embodiment of the organizer has a lock that selectively restricts rotation of the carousels relative end panels that receive the axle.

12 Claims, 5 Drawing Sheets

Fig. 3A
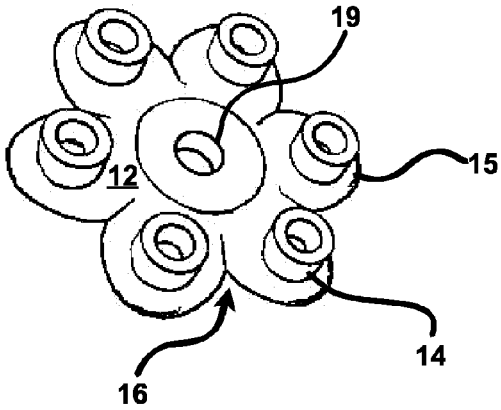
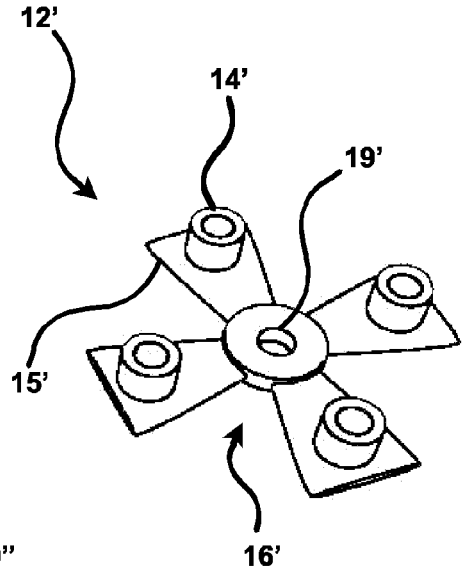
Fig. 3B
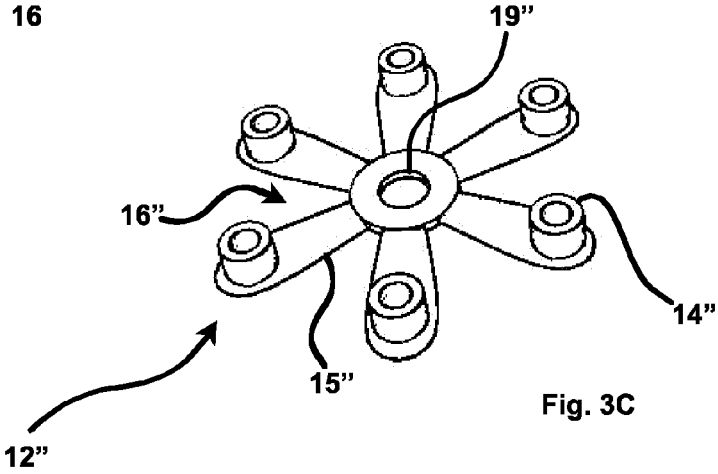
Fig. 3C

ORGANIZER FOR DISPENSING ROLLED GOODS

SUMMARY OF THE INVENTION

The invention is an organizer for dispensing rolled goods, such as foil, plastic wrap, gift wrap, or the like. The organizer will include a first carousel adjacent a first end of an axle, and a second carousel adjacent a second end of the axle. Preferably, the axle will comprise a single rod passing through both carousels; however, a pair of shorter rods aligned along a common axis would suffice.

The invention will also include a plurality of connector hubs on the first and second carousels. Each respective is hub adapted to receive a hollow end of a respective roll of rolled goods. The rolls are rotatably mounted to the carousels opposing pairs of hubs.

The invention will also include a lock for selectively restricting movement of at least one of the first and second carousels. The rolled goods may be removed or unrolled from the organizer by turning the carousels until a selected roll is in a dispensing position, then removing (by unrolling or unwinding) the goods from the selected roll. In a preferred embodiment, the organizer will also include a first panel adjacent the first carousel, and configured to receive a first end of the axle, and a second panel adjacent the second carousel, and configured to receive a second end of the axle.

The organizer may also include a top panel, bottom panel, back panel, and a front panel. The front panel may optionally include an upper flap having a common edge with the top panel, and a lower flap having a common edge with the bottom panel. In this embodiment of the organizer, a cutter may be positioned on the lower flap.

The panels may form a box that envelops the rolled goods when the box is in an assembled position. Additionally, these panels may be interconnected and generally coplanar when unassembled.

In a preferred embodiment, the first and second carousels are made from a pliable material so that a roll of goods may be mounted to a respective hub by bending the carousel from a standard position to a displaced position, thereby enabling the hub to engage within the hollow end of the roll. It is preferred that the first and second carousels be of identical construction; each has a plurality of tabs extending outwardly from its center, and the hubs extend from the tabs. The lock of the organizer may also include a peg that can selectively engage between tabs to restrict rotation of the carousel.

The first panel of the organizer may have a channel formed therein. In this embodiment, the peg passes through the channel and engages the first carousel to restrict its movement. Further, it is preferred to extend the peg from a pliable slat coupled to an outer face of the first panel, and bias the slat to engage the peg in a locked position. When the slat is bent outwardly, the peg is disengaged from the carousel and movement of the carousels is enabled.

Other objects, advantages and novel features of the present invention will become apparent from the following detailed description of the invention when considered in conjunction with the accompanying drawings.

BRIEF DESCRIPTION OF THE DRAWINGS

FIGS. 3A, 3B, and 3C are perspective views of alternative designs for the carousel.

DETAILED DESCRIPTION OF THE PREFERRED EMBODIMENTS

Figure 1:
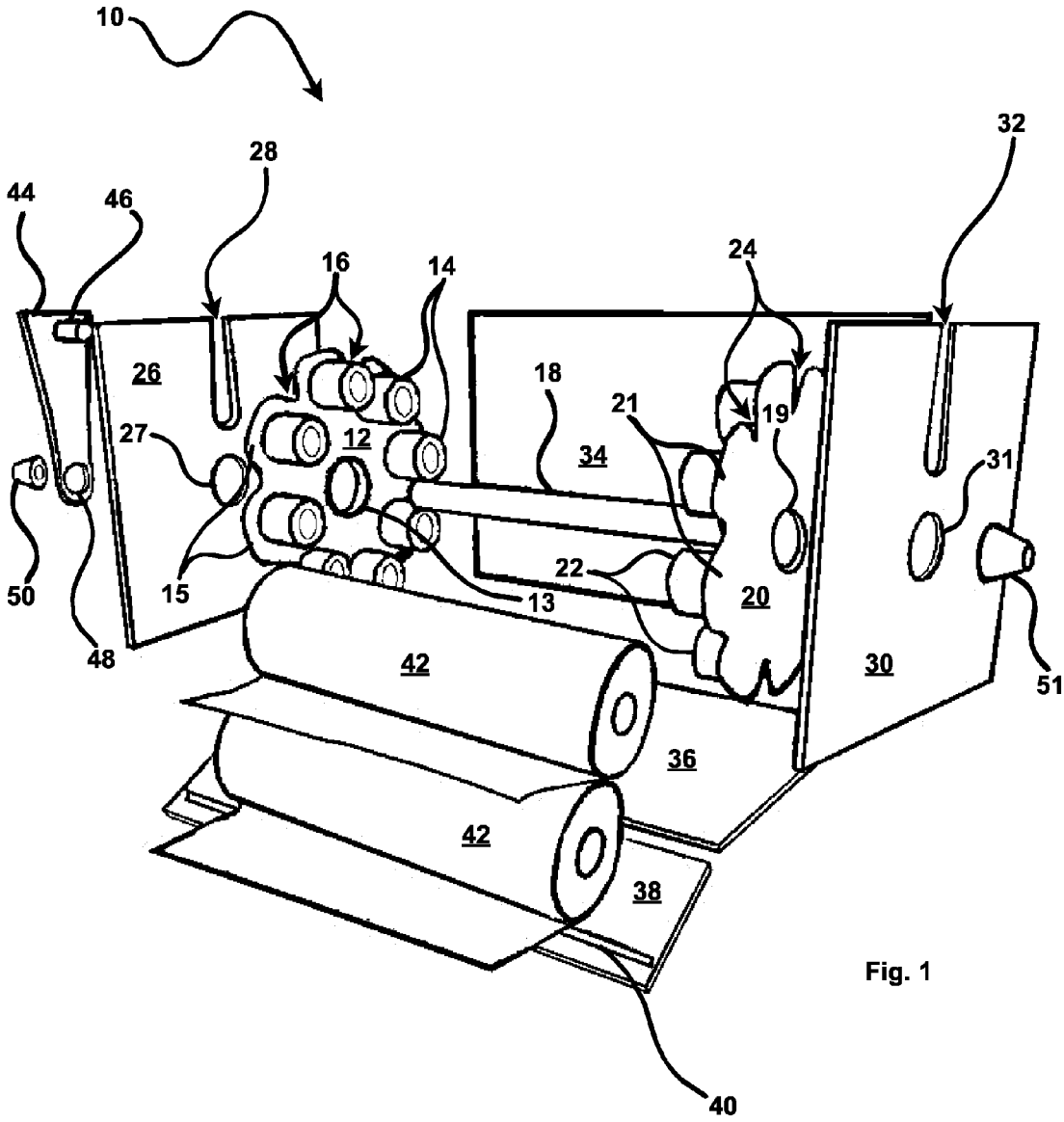
FIG. 1 is an exploded view showing the various parts of the organizer, according to the principles of the invention.

FIG. 1 shows an exploded and perspective view detailing the various parts and aspects of the organizer for dispensing rolled product. The organizer 10 includes a first carousel 12, which has a plurality of tabs 15 extending from a generally central opening 13. A hub 14 extends from each of the respective tabs 15. Spaces 16 separate each of the tabs 15.

As shown in FIG. 1, the organizer 10 will also include an axle 18 extending from the first carousel 12 to the second carousel 20. Preferably, the second carousel 20 is identical to the first carousel 12, and is generally positioned on the axle 18 at an opposite end thereof. A plurality of tabs 21 extend outwardly from a centrally located opening 19 of the second carousel 20, and spaces 24 separate each adjacent tab 21. A respective hub 22 extends from each tab 21.

Still referring to FIG. 1, each respective hub 14, 22 of the first 12 and second 20 carousels is adapted to engage a hollow end of a rolled good 42. FIG. 1 shows carousels 12, 14 having eight hubs; however, the organizer 10 can incorporate carousels 12, 14 having any desired number of hubs in order to suit the desired need.

As shown in FIG. 1, the organizer 10 has a first panel 26 positioned adjacent the first carousel 12 and proximate a first end of the axle 18, and a second panel 30 positioned adjacent the second carousel 20 and proximate the second end of the axle 18. The first panel 26 bears a channel 28 that is shown to extend from an edge of the first panel 26 and inwardly. The first panel 27 may bear a hole 27 to accommodate an end of the axle 18. An end cap 50 covers the end of the axle 18 as the end protrudes outwardly from the first panel 26.

Still referring to FIG. 1, a pliable slat 44 is positioned on an outer face of the first panel 26. The slat 44 has an aperture 48 positioned at one end, and a peg 46 positioned near an opposite end. An end of the axle 18 will pass through the aperture 48, and the slat 44 will be held to the first panel 26 by tightly attaching the end cap 50 to the axle 18. When properly mounted, the peg 46 will protrude through the channel 28 formed in the panel 26; the peg 46 should be formed to be long enough to engage within spaces 16 between the tabs 14 of the first carousel 12, thereby restricting movement of the carousels 12, 14.

The second panel 30 of the organizer 10 shown in FIG. 1 may be identical to the first panel 26. It may have a channel 32 extending from an edge, and a hole 31 positioned centrally in order to accommodate an end of the axle 18.

As seen in FIG. 1, the organizer 10 includes a back panel 34 and a bottom panel 36. Preferably, the organizer 10 will also include a top panel (not viewable in FIG. 1) and a front panel (not viewable in FIG. 1) so that the rolled goods 42 may be neatly enveloped and stowed. To preserve the simplicity of the drawing, these additional panels are not shown in FIG. 1, but nonetheless remain an important aspect of the organizer and are disclosed hereinafter. The organizer 10 may also include a lower flap 38 positioned adjacent the bottom panel 36. A cutter 40 is located on the lower flap to assist in removing goods from a selected roll 42.

Figure 2:
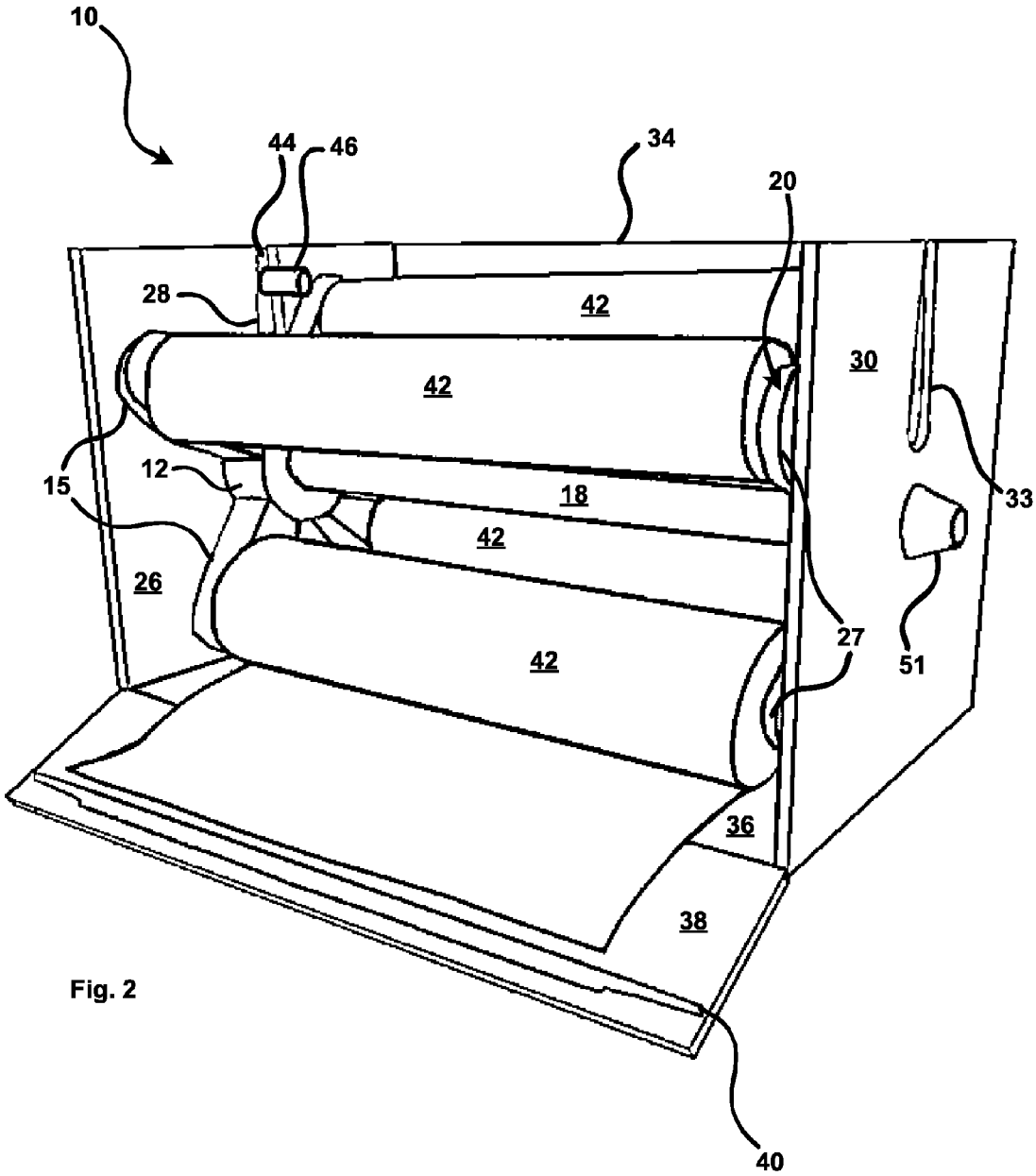
FIG. 2 is a perspective view of a preferred embodiment of the organizer.

FIG. 2 provides a perspective view of the inventive system 10. Rolled goods 42 (such as gift wrap, for example) are mounted to tabs 15 of the first 12 and second 20 carousels. Each roll 42 is free to rotate about its longitudinal axis; additionally, the carousels 12, 20 are also rotatable about an axis through the axle 18.

Still referring to FIG. 2, the axle 18 passes through the first carousel 12 and second carousel 20, and engages adjacent its ends with the first panel 26 and second panel 30. An end cap 51 covers the end of the axle that may protrude from the second panel 30.

As shown in FIG. 2, the first panel 26 bears a channel 28 that is able to accommodate a locking means. The locking means of the embodiment shown in FIG. 2 comprises a slat 44 coupled to an outer face of the first panel 26, and a peg 46 extending outwardly from the slat 44 and through the channel 28 in the first panel 26. The peg 46 should be long enough to engage a hub 15 of the first carousel 12 when the slat 44 is flush against the first panel 26. In this embodiment, the slat 44 is constructed of a pliable material so that it is biased against the first panel, yet is deflectable to enable the first carousel 12 to clear the peg 46 and enable rotation.

As shown in FIG. 2, the organizer 10 includes a back panel 34, and a bottom panel 36. The organizer may also include a front panel (not viewable in FIG. 2; viewable in FIG. 5) that includes a bottom flap 38 connected to the bottom panel 36. A cutter 40 is positioned on an inner face of the bottom flap 38. As one rotates the carousels 12,20 so that a desired roll 42 is adjacent the lower position, the goods may be unraveled or removed from the organizer, then cut using cutter 40 to the desired length. The cutter 40 is shown to be a single blade type; however, a u-type cutter with a wheel rolling along parallel tracks, are also within the scope and spirit of this invention.

FIG. 2 shows that the first 12 and second 20 carousels bear four tabs for the mounting of four rolls of rolled goods 42. As aforementioned, the carousels may be designed to accommodate any number of tabs and/or rolls. In any regard, it is preferred that the first 12, 20 be of identical construction so that they form mirror images of one another when positioned adjacent opposing ends of the axle 18. Additionally, note that second panel 30 bears a channel 33; optionally, an additional locking means (discussed above) may be affixed to the outer face of the second panel 30. In order to simplify construction, however, it is preferred that the first and second panels bear similar construction, even if only one locking means is incorporated into the organizer.

As shown in FIG. 2, the first carousel 12 is slightly displaced from the inner face of the first panel; similarly, the second carousel 20 is slightly displaced from an inner surface of the second panel. In order to mount the rolled goods onto the carousels 12, 20, one should place the hollow end of a roll 42 over a selected hub of the first carousel 12. Next, one should deflect a corresponding hub 27 of the second carousel 20 outwardly so that the roll 42 can fit tightly between the carousels, yet be free to rotate about the longitudinal axis of the roll 42. Obviously, one could also perform the mounting step by initially placing the hollow end of the roll 42 about a hub of the second carousel 20 before deflecting a tab 15 of the first carousel 12 outwardly to accommodate the length of the roll 42, then allow the roll 42 to fit snugly between the carousels. As shown herein, the rolled goods may be mounted to carousels with the carousel assembly positioned within the organizer; conversely, the rolls may also be removed from the carousels while in the position shown in FIG. 2 as well.

As shown in FIG. 2, the carousels 12, 20 should be set apart on the axle 18 in order to accommodate the standard length of the rolled goods 42. For example, gift wrap may be purchased in rolls that are 30 inches in length. As such, the organizer 10 may designed with this in mind, by mounting the carousels 30 inches apart on the axle 18. In another embodiment, the carousels 12, 20 may be displaceable along the axle 18, which would allow the organizer 10 to accommodate rolls 42 of varying lengths. Optionally, the axle 18 may be a telescoping rod which would allow selective adjustment of the length of the axle 18.

FIGS. 3A-3C show various options for the design of the carousels 12, 20. FIG. 3A shows a carousel 12 having six hubs 14, each protruding from rounded tabs 15 that extend from a centrally-positioned opening 19 and also bear spaces 16 therebetween. FIG. 3B shows a carousel 12' having four tabs 15' radiating outwardly from a generally central opening 19', each tab 15' having a generally trapezoidal configuration having a narrow end proximate the opening 19' and a wider end adjacent its circumference of the carousel 12'. In this embodiment of the carousel 12', the spaces 16' between the tabs 15' are much more pronounced, which may make it easier for a locking means (discussed above) to engage one of the tabs 15'. FIG. 3C shows a carousel 12" having six tabs 15"; this embodiment bears a flower-like design wherein the tabs 15" are rounded and narrow, thereby creating space 16" between the petals (aka hubs 15") of the flower shape. As shown, this design of the carousel 12" may require the hubs 14" to be more slender than the other embodiments in order to accommodate the narrow configuration of the tabs 15".

Figure 4A:
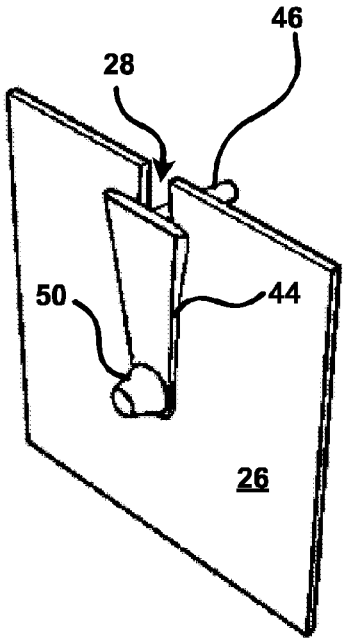
FIGS. 4A and 4B are isolated views showing the first panel and a preferred locking mechanism.
Figure 4B:
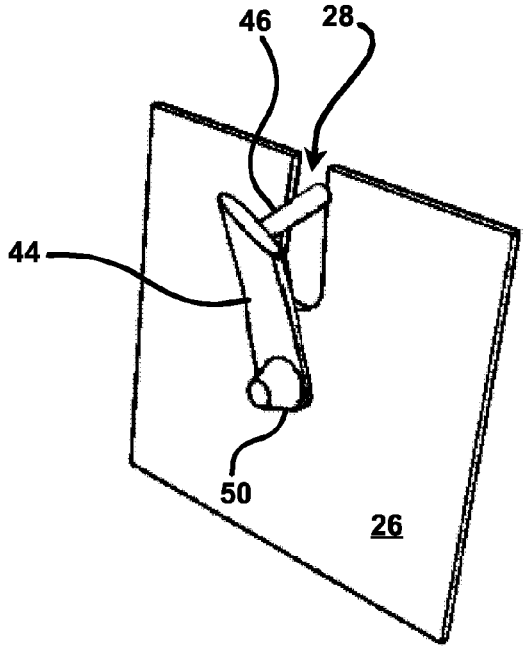

FIGS. 4A and 4B show the outer face of the first panel in combination with the locking means. In its standard position shown in FIG. 4A the slat 44 is biased to a position flush with an outers surface of the first panel 26. In this position, the peg 46 protrudes through the channel 28 formed in the first panel 26 so that the peg 46 engages the first carousel 12 (shown and discussed above). In preferred embodiments, the axle (shown and discussed above) protrudes slightly from the second panel 26. The slat 44 fits over the end of the axle, and the end cap 50 holds the slat 44 snugly against the surface of the first panel 26.

As shown in FIG. 4B, the slat 44 comprises a generally pliable material, and may be deflected outwardly from the first panel 26. As the slat 44 is deflected outwardly, the peg 46 moves outwardly in the channel 28, and into a position wherein the peg 46 disengages from the first carousel 12.

Figure 5:
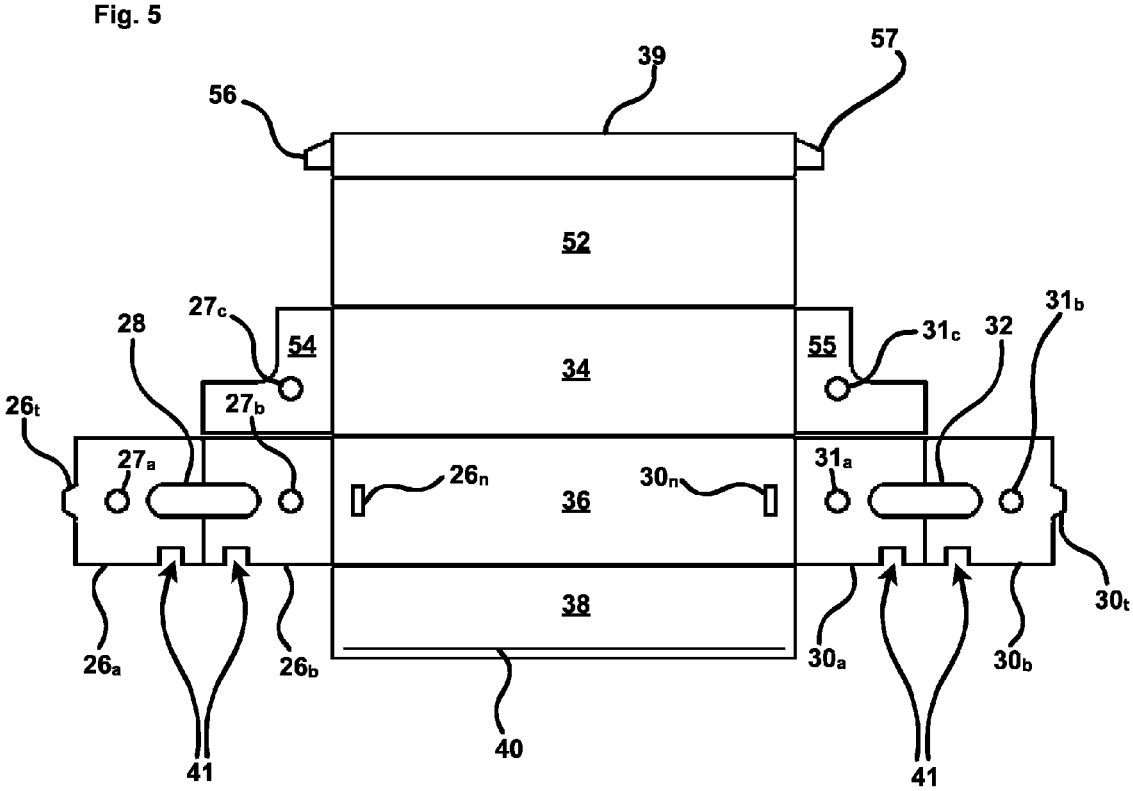
FIG. 5 shows a plan view of a preferred embodiment of an unassembled box.

FIG. 5 shows a plan view of the panels of the box that may encase the organizer 10. The organizer 10 may be enclosed within a box of unitary construction that is stamped onto pliable polymer, plastic, or cardboard, and imprinted with scores enabling a folded construction and assembly.

As shown in FIG. 5, the organizer 10 will include a bottom panel 36 having a general rectangular configuration, and a first panel 26 bordering the first short end of the rectangle, and a second panel 30 at the opposite end. The first panel 26 bears a first portion $\mathbf{26}_a$ that will fold over the second portion $\mathbf{26}_b$. Note that the channel 28 formed in the first panel 26 must be formed on each of the first $\mathbf{26}_a$ and second $\mathbf{26}_b$ portions of the first panel 26. In order to accommodate the axle 18 (discussed above), each of the first $\mathbf{26}_a$ and second $\mathbf{26}_b$ portions of the first panel 26 bear a respective hole $\mathbf{27}_a$ and $\mathbf{27}_b$ that will align when the portions are folded properly. A tab $\mathbf{26}_t$ is positioned along an outer edge of the first portion $\mathbf{26}_a$ and will engage within a notch $\mathbf{26}_n$ positioned on the bottom panel 36. Of course, the channel 28 may be formed so that channel segment on the second portion $\mathbf{26}_b$ is long enough to enable the hole 27 to be accessible to the axle 18. A cut-out 41 is positioned along a bottom edge of each portion to accommodate the cutter 40 that that extends along the lower flap 38.

Still referring to FIG. 5, the second panel 30 comprises a first portion $\mathbf{30}_a$ and second portion $\mathbf{30}_b$. The parts of the second panel 30 are in many ways a mirror-image of the first panel 26. Specifically, the second panel 30 bears a first portion $\mathbf{30}_a$ and a second portion $\mathbf{30}_b$ that will fold over the first part $\mathbf{30}_a$. The second part will bear a tab $\mathbf{30}_t$ configured to engage within a notch $\mathbf{30}_n$ formed on the bottom panel 36. A cutout 41 is formed on each of the first 30*a* and second 30*b* portions, and each will bear holes $\mathbf{31}_a$, $\mathbf{31}_b$ that will align when folded properly and the second panel 30 is assembled. The channel 32 will extend into both the first 30*a* and second portions 30*b* of the second panel.

As shown in FIG. 5, the organizer 10 comprises a box including a back panel 34 connected at an edge to the bottom panel 36, and a top panel 52 connected at an edge to the back panel 34. As shown in FIG. 5, opposing edges of the back panel may bear respective flaps 54, 55. The first flap 54 tucks between the first $\mathbf{26}_a$ and second $\mathbf{26}_b$ portions of the first panel 26 when the organizer is assembled. Conversely, the second flap 55 tucks between the first 30*a* and second 30*b* portions of the second panel 30 when the organizer is in an assembled condition. The flap 54 may bear a hole $\mathbf{27}_c$, that aligns with holes $\mathbf{27}_a$ and $\mathbf{27}_b$ when the flap 54 is tucked between the first $\mathbf{26}_a$ and second $\mathbf{26}_b$ portions of the first panel 26. Accordingly, flap 55 may bear a hole 31*c* that alights with holes $\mathbf{31}_a$ and $\mathbf{31}_b$ when the flap 54 is tucked between the first $\mathbf{30}_a$ and second $\mathbf{30}_b$ portions of the second panel 30.

Still referring to FIG. 5, an upper panel 52 shares a common long edge with back panel 34, and the upper portion 39 of the front panel shares a common edge with the top panel 52 at the second long edge of the rectangular top panel 52. The upper flap 39 bears flaps 56, 57 that tuck between respective portions of the first panel 26 and second panel 30. When fully folded, the organizer 10 becomes a self-contained elongate rectangular box.

Having described the invention and its drawing and diagrams in detail, it is to be understood that these descriptions are for illustrative purposes, and should not be construed define the metes and bounds of the invention. Rather, the scope and breadth of the invention shall be limited only by the appended claims.

I claim:

1. An organizer for dispensing rolled goods, the organizer comprising:

an axle;

a first carousel adjacent a first end of the axle;

a second carousel adjacent a second end of the axle;

a first panel adjacent the first carousel and configured to receive the first end of the axle;

a second panel adjacent the second carousel and configured to receive the second a top panel; a bottom panel; a back panel; a front panel that includes an upper flap having a common edge with the top panel, and a lower flap having a common edge with the bottom panel; a cutter on the lower flap; the first panel;

a plurality of connector hubs on the first and second carousels, each respective hub adapted to receive a hollow end of a respective roll of rolled goods, each respective roll being rotatably mounted to a respective opposing pair of hubs;

a lock for selectively restricting movement of at least one of the first and second carousels, the lock including a pliable slat coupled to the outer surface of the first panel adjacent a first end of the pliable slat; and, a peg extending generally orthogonally from adjacent the second end of the pliable slat, such that the peg extends through the slot to engage the first carousel when the organizer is in a locked position, wherein, rolled goods are removable from the organizer by rotating the carousels until a selected roll is in a dispensing position, thereby enabling removal of the rolled goods from the selected roll.

2. The organizer as in claim 1, wherein, the first panel, second panel, top panel, bottom panel, and front panel from a box substantially enclosing the rolled goods when the box is in an assembled position, and the panels are interconnected to form a planar structure when the box is in an unassembled position.

3. The organizer as in claim 1, the first and second carousels each comprising a pliable material; wherein, a roll of rolled goods is rotatably mounted to a respective hub by deflecting the carousel from a standard position to a displaced position, thereby enabling the hub to engage within the hollow end of the roll.

4. The organizer as in claim 1, wherein each of the first and second carousels have a plurality of tabs extending outwardly from its center.

5. The organizer as in claim 4, the peg positioned to engage between tabs to restrict rotation of the carousel.

6. The organizer as in claim 1, wherein the pliable slat is biased to engage the peg with the first carousel when the organizer is in a locked position and is outwardly deflectable to enable selective rotation of the carousels.

7. The organizer as in claim 6, further comprising an end cap covering a terminus of the first end of the axle;

an aperture formed in the slat, and wherein, the axle passes through the aperture.

8. An organizer for dispensing rolled goods, the organizer comprising:

an axle;

a first panel positioned to receive the axle adjacent its first end;

a second panel positioned to receive the axle adjacent its second end;

a first carousel having a plurality of tabs extending radially outward from its center, the first carousel positioned adjacent the first panel;

a second carousel having a plurality of tabs extending radially outward from its center, the second carousel positioned a top panel; a bottom panel; a back panel; and a front panel including an upper flap having a common edge with the top panel, and a lower flap having a common edge with the bottom panel; a cutter on the lower flap; a slot formed along a surface of the first panel, the slot extending from an upper edge to a terminal end positioned at a generally central location of the first panel, the slot being formed such that the axle engages adjacent a terminal end of the slot; a pliable slat coupled to an outer face of the first panel; a peg extending from the slat and biased to protrude through the slot to engage the peg with one of the first or second carousels when the organizer is in a locked position, the slat being outwardly deflectable to enable selective rotation of the carousels; a respective connector hub on each tab of the first and second carousels, each respective hub adapted to receive a hollow end of a respective roll of rolled goods, each respective roll being rotatably mounted to a respective opposing pair of hubs;

rolled goods are removable from the onrganizer by rotating the carousels until a selected roll is in a dispensing position, thereby enabling removal of the rolled goods from the selected roll.

9. The organizer as in claim 8, wherein the panels of the box are interconnected at respective edges, enabling the box to assume a planar configuration when the box is in an unassembled condition.

10. The organizer as in claim 8, the first and second carousels each comprising a pliable material; wherein, a roll of rolled goods is mounted to a respective hub by bending the carousel from a standard position to a displaced position, thereby enabling the hub to engage within the hollow end of the roll.

11. An organizer for dispensing rolled goods, the organizer comprising:

an axle;

a first carousel made from a pliable material and having a plurality of tabs extending radially outward from its center, the first carousel positioned adjacent a first end of the axle;

a second carousel having a plurality of tabs extending radially outward from its center, the second carousel positioned adjacent a second end of the axle;

a respective connector hub on each tab of the first and second carousels, each respective hub adapted to receive a hollow end of a respective roll of rolled goods, each respective roll being rotatably mounted to a respective opposing pair of hubs;

a box having a first panel adjacent the first carousel, and configured to receive a first end of the axle, the first panel having a channel formed therein;

a second panel adjacent the second carousel, and configured to receive a second end of the axle;

a top panel;

a bottom panel;

a back panel; and, a front panel having an upper flap having a common edge with the top panel;

a lower flap having a common edge with the bottom panel; and, a cutter on the lower flap, the panels of the box being interconnected at respective edges to enable a planar configuration when the box is in an unassembled condition;

a pliable slat coupled to an outer face of the first panel;

a peg extending from the slat and biased to protrude through the channel and to engage the first carousel in a locked position, the slat being outwardly deflectable to enable selective rotation of the carousels;

wherein, a roll of rolled goods is rotatably mounted to a respective hub by bending the first carousel from a standard position to a displaced position, thereby enabling the hub to encage within the hollow end of the roll;

and wherein, the rolled goods are selectively enclosable within the box, and are removable from the organizer by rotating the carousels until a selected roll is in a dispensing position, thereby enabling removal of the rolled goods from the selected roll.

12. The organizer as in claim 11, further comprising an end cap positioned adjacent a first end of the slat, the end cap being configured to engage a terminal end of the axle.

* * * * *